US005931986A

United States Patent [19]

Peurrung et al.

[11] Patent Number: 5,931,986

[45] **Date of Patent: *Aug. 3, 1999**

[54] METHOD AND APPARATUS FOR CONFINEMENT OF IONS IN THE PRESENCE OF A NEUTRAL GAS

[75] Inventors: Anthony J. Peurrung; Stephan E. Barlow, both of Richland, Wash.

[73] Assignee: Battelle Memorial Institute, Richland, Wash.

[ * ] Notice: This patent issued on a continued prosecution application filed under 37 CFR 1.53(d), and is subject to the twenty year patent term provisions of 35 U.S.C. 154(a)(2).

[21] Appl. No.: 08/696,221

[22] Filed: Aug. 13, 1996

[51] Int. Cl.[6] ..... B03C 1/30

[52] U.S. Cl. ..... 95/28; 95/78; 96/1; 96/3; 96/61

[58] Field of Search ..... 95/27, 28, 31, 95/34, 269, 272, 78; 96/1–3, 61, 62; 55/337, 394, 399, 456, 457

[56] References Cited

U.S. PATENT DOCUMENTS

| | | | |
|---|---|---|---|
| 3,113,427 | 12/1963 | Meyer | 95/28 |
| 3,374,941 | 3/1968 | Okress | 96/3 X |
| 4,046,527 | 9/1977 | Kistemaker | 96/3 |
| 4,156,832 | 5/1979 | Kistemaker et al. | 96/1 X |
| 4,830,638 | 5/1989 | Priestley, Jr. | 96/3 |
| 5,037,546 | 8/1991 | Janczak et al. | 96/1 |

FOREIGN PATENT DOCUMENTS

| | | | |
|---|---|---|---|
| 485679 | 5/1992 | European Pat. Off. | 95/28 |
| 2933504 | 2/1981 | Germany | 95/28 |
| 56-40424 | 4/1981 | Japan | 95/28 |
| 62-213859 | 9/1987 | Japan | 95/28 |
| 1488244 | 10/1977 | United Kingdom | 95/28 |

OTHER PUBLICATIONS

O'Neil et al, "Transport to Thermal Equilibrium of a Pure Electron Plasma", American Institute of Physics, *Physics Fluids,* vol. 22, No. 2, Feb. 1979.

Peurrung et al, "The Non–Neutral Plasma: an Introduction to Physics with Relevance to Cyclotron Resonance Mass Spectrometry", *International Journal of Mass Spectrometry and Ion Processes,* vol. 157/158, Sep. 17, 1995.

*Primary Examiner*—Richard L. Chiesa
*Attorney, Agent, or Firm*—Paul W. Zimmerman

[57] ABSTRACT

The present invention is an apparatus and method for combining ions with a neutral gas and flowing the mixture with a radial flow component through a magnetic field so that the weakly ionized gas is confined by the neutral gas. When the weakly ionized gas is present in sufficient density, a weakly ionized non-neutral plasma is formed that may be trapped in accordance with the present invention. Applications for a weakly ionized non-neutral plasma exploit the trap's ability to store and manipulate ionic species in the presence of neutral gas. The trap may be connected to a mass spectrometer thereby permitting species identification after a fixed period of time. Delicate and/or heavy particles such as clusters may be held and studied in a "gentle" environment. In addition, the trap can provide a relatively intense, low-energy source of a particular ion species for surface implantation or molecular chemistry. Finally, a long trap may permit spectroscopy of unprecedented accuracy to be performed on ionic species.

15 Claims, 2 Drawing Sheets

METHOD AND APPARATUS FOR CONFINEMENT OF IONS IN THE PRESENCE OF A NEUTRAL GAS

This invention was made with Government support under Contract DE-AC06 76RLO 1830 awarded by the U.S. Department of Energy. The Government has certain rights in the invention.

FIELD OF THE INVENTION

The present invention relates generally to confinement of ions in the presence of a neutral gas. More specifically, the invention is stable confinement of weakly ionized gas. The term "weakly ionized gas" as used herein refers to a gas wherein the neutral species density greatly exceeds the ionic species density, but is not a plasma. The term "weakly ionized non-neutral plasma" as used herein means that the plasma is at a pressure above about 100 mTorr. Pressures below about 100 mTorr transition to a fully ionized non-neutral plasma. The term "stable confinement" as used herein means that there is essentially no limitation on the duration of confinement of the ions provided that energy in the form of rotation is continuously supplied.

BACKGROUND OF THE INVENTION

Ion or plasma trapping is well known. Penning traps are routinely used in non-neutral plasma physics for study of basic plasma physics, fluid mechanics, atomic physics, nuclear physics and particle physics. These traps operate under vacuum and trap the fully ionized plasma in a magnetic field. Vacuum conditions are well known and are typically about $10^{-7}$ torr or less. The presence of neutral gas tends to disrupt the behavior of a fully ionized plasma whereas behavior of the fully ionized plasma is recovered upon reduction of neutral gas pressure. Penning traps are sensitive to mechanical precision of surfaces.

Paul traps relying on radiofrequency energy are used to trap weakly ionized gases. However, Paul traps can only trap large particles at pressures approaching atmospheric pressure. Further, a Paul trap must remain substantially symmetrical if scaled up.

Accordingly, there is a need for an ion trap that is robust, insensitive to symmetry and pressure.

SUMMARY OF THE INVENTION

The present invention is an apparatus and method for combining ions with a neutral gas and flowing the mixture with a azimuthal flow component through a magnetic field so that the ions are confined by the neutral gas. When the ions are present in sufficient density, a weakly ionized non-neutral plasma is formed that may be trapped in accordance with the present invention.

It is an object of the present invention to confine or trap ions in a neutral gas.

Applications for a weakly ionized non-neutral plasma exploit the trap's ability to store and manipulate ionic species in the presence of neutral gas. The trap may be connected to a mass spectrometer thereby permitting species identification after a fixed period of time. The trap provides an environment with a well characterized Maxwellian energy distribution at a controllable temperature (the temperature of the neutral gas). Switching between positive and negative ion confinement requires only a change in the direction of the magnetic field or gas rotation direction. Delicate and/or heavy particles such as clusters may be held and studied in a "gentle" environment. In addition, the trap can provide a relatively intense, low-energy source of a particular ion species for surface implantation or molecular chemistry. Finally, a long trap may permit spectroscopy of unprecedented accuracy to be performed on ionic species.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DESCRIPTION OF THE PREFERRED EMBODIMENTS (s)

The method of the present invention is for trapping ions, having the steps of (a) forming a mixture of the ions with a neutral gas; and (b) flowing the mixture through a magnetic field wherein the flow is substantially transverse to the magnetic field lines and has a rotational flow component.

In a preferred embodiment, the density of the ions is sufficient to form a weakly ionized non-neutral plasma. A weakly ionized non-neutral plasma is characterized by (1) the neutral species density greatly exceeds the ionic species density, and (2) the ion neutral collision frequency greatly exceeds the cyclotron frequency. The overall pressure of the weakly ionized gas may range from about 100 mTorr to well above atmospheric pressure. It is preferred to operate at about atmospheric pressure. In order to achieve separation of the ions or non-neutral plasma, rotational motion of the neutral gas is imposed in the presence of a magnetic field.

The flow of gas may be vessel confined or pressure confined. In other words, a smoke ring in air is an example of a pressure confined flow of gas. Gas flowing through a pipe or a volume of gas contained within a vessel are examples of vessel confined flow of gas. In a preferred embodiment, the flow of gas is vessel confined.

The magnetic field may be applied by any kind of magnet in any position relative to the flow of gas insofar that the flow of gas is substantially transverse to the magnetic field lines. Transverse refers to a component of flow perpendicular to the magnetic field lines. Substantially refers to angles between flow direction and magnetic field line direction from 90 degrees (fully perpendicular) to near zero degrees (nearly parallel). In a preferred embodiment, the magnet is placed external to the vessel.

A rotational flow component is necessary to achieve a flow field gradient that achieves a separation. Just as air rotation through a Hilsh tube can be separated into hot and cold streams, so does rotation of the mixture result in separation of the ions from the neutral gas. A rotational flow component may be achieved in any way including but not limited to circular flow, vortex flow, toroidal flow, and combinations thereof. Circular flow is pure rotation without any axial component of flow. Vortex flow is a helical flow wherein rotation is superimposed on an axial flow. Toroidal flow is a smoke ring wherein the ring is in rotation about the circular axis and the entire toroid may have an imposed axial flow along a longitudinal axis through the center of the toroid. The rotation may be imposed by tangential jets into a vessel or by rotation of the vessel. In a preferred embodiment, the rotational flow is induced by rotation of the containment vessel.

Figure 1:
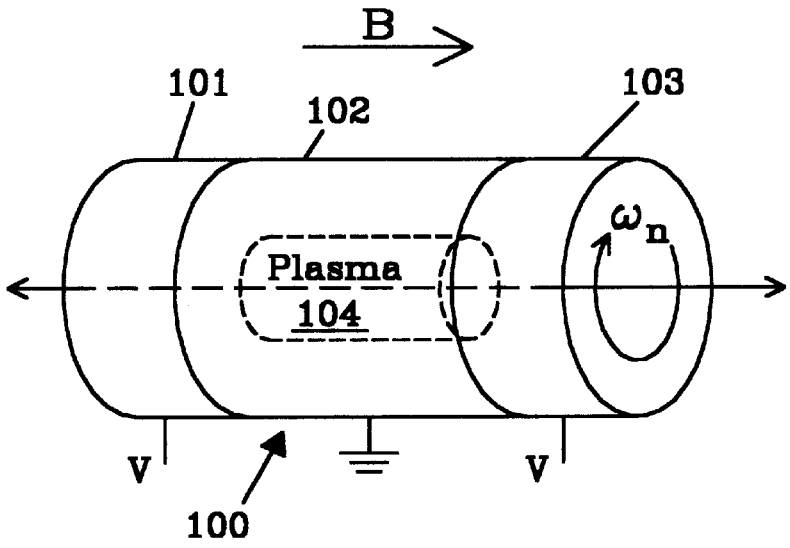
FIG. 1 is a trap according to the present invention.

An apparatus is depicted in FIG. 1. The apparatus has a strong axial magnetic field B and a conducting outer wall 100 divided into segments 101, 102, 103 for plasma measurement and control. "Gates" 101, 103 at each axial end of the plasma 104 must be maintained at a potential V sufficient to repel the plasma 104 and prevent particle loss. Unlike the conventional Malmberg/Penning trap, however, a neutral gas must be present and must be rotated (107$_n$) to provide a radially inward force on the plasma 104 and ensure confinement.

More generally, the apparatus for trapping ions is (a) a magnet with an associated magnetic field;

(b) a source of a gas mixture having a neutral gas and ions; and (c) a confinement imparting a rotational flow component to the gas mixture through the magnetic field and substantially transverse to the magnetic field lines.

The confinement may be a pressure boundary as in a smoke ring, or a physical boundary as a containment vessel. A preferred embodiment is a containment vessel having the gas mixture within, and a magnet external from the containment vessel. It is further preferred that the containment vessel be substantially cylindrical. However, spherical and other cross sectional shapes would work, but likely be less effective in trapping the weakly ionized gas.

Figure 2A:
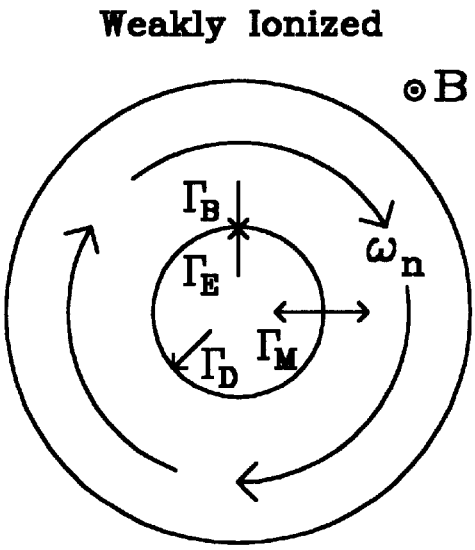
FIG. 2*a* is a diagram of radial fluxes for an infinitely long embodiment of the present invention.
Figure 2B:
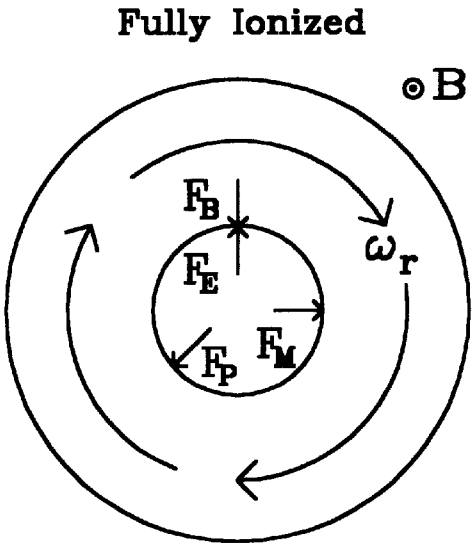
Fig. 2b (Prior Art)
FIG. 2*b* is a diagram of radial fluxes for an infinitely long embodiment of the prior art.

In order to further clearly describe the present invention, it will be compared to trapping fully ionized plasma. Both are non-neutral. A leading distinction is that the trapping of ions is made possible by the presence of a neutral gas rather than hindered as for trapping a fully ionized plasma. FIG. 2*a* is a diagram showing the radial fluxes that must balance for an infinitely long weakly ionized non-neutral plasma (WINP) and, for comparison, FIG. 2*b* shows the forces that must balance for a similar fully ionized non-neutral plasma. The four fluxes that must balance are the magnetic, electric, diffusive, and inertial fluxes.

A number of additional assumptions simplify calculation of the characteristics of a WINP. The plasma, trap, and magnetic field are assumed to be cylindrically symmetric and aligned. The direction of the magnetic field is taken to be along the 'z' axis. The plasma density at the wall radius is assumed to be sufficiently low that wall loss can be neglected. A plasma in "contact" with the outer wall will lose charge and shrink radially in much the same way as a conventional fully ionized non-neutral plasma. The neutral gas within the trap is assumed to flow in the purely azimuthal direction with a constant angular velocity. Finally, the neutral gas is assumed to have a constant density and pressure. Although laboratory conditions are likely to satisfy this assumption, its violation would only lead to a dependence of the diffusion and mobility constants on radial position.

The magnetic flux results from the magnetic force that ions must feel as they are "dragged" azimuthally along with the neutral gas. This magnetic force is related to the Hall effect emf that arises in a wire carrying current across magnetic field lines. In the present case, current results from forced neutral gas motion, and the emf is the force that opposes the natural outward expansion of the plasma. The magnetic force has a magnitude $q(v_n \times B)/c$, in Gaussian units, where 'q' is the signed ionic charge. Assuming singly charged ions, this force becomes $-(e\omega_n Br/c)\hat{r}$, where e is the magnitude of the electron's charge and $\hat{r}$ is the radial unit vector. This force leads to a magnetic particle flux given by $$\Gamma_B = -\left(\frac{\mu n \omega_n Br}{c}\right)\hat{r}, \tag{1}$$

where $\mu$ is the ion mobility and n(r) is the plasma's ion density as a function of radial position. Similarly, the electric force qE(r) leads to an electric flux given by $$\Gamma_E = n\mu E, \tag{2}$$

where E is the electric field arising from both the plasma itself and from the trap's confining electric field. The diffusive flux is given by Fick's law, $$\Gamma_D = -D\nabla n, \tag{3}$$

where D is the ionic diffusion constant. This diffusion constant is calculated for each particular gas composition and pressure. The effect of various types of ion-neutral interactions including charge-exchange reactions must be accurately accounted for. Finally, the inertial force on an ion of mass $m_i$ within a gas containing a single species of mass $m_n$ has the value $(m_i - m_n)\omega_n^2 r\hat{r}$ resulting in an inertial ion flux of $$\Gamma_M = \delta m n \mu \omega_n^2 r/e\hat{r} \tag{4}$$

where $\delta m = (m_i - m_n)$.

Equation (4) implies that the inertial flux can be either inwardly or outwardly directed depending on the sign of $\delta m$. For the case that $m_i < m_n$, the inertial flux acts to reinforce the magnetic flux, and there can be no Brillouin limit to the density that can achieved by arbitrarily increasing the frequency of neutral gas rotation. In practice, however, such rotation frequencies are unlikely to be achieved. The inertial force should be negligible whenever $\Gamma_M/\Gamma_B \ll 1$, i.e., $(\delta m/m_n(\omega_n/\Omega) \ll 1$, where $\Omega = eB/m_i c$ is the ion cyclotron frequency. Since experimental limitations on the maximum possible gas rotation speed will ensure that $\omega_n \Omega \ll 1$ we hereafter neglect inertial terms under the assumption that the plasma is composed of relatively light ions.

The cold plasma limit is obtained by setting T=D=0, where T is necessarily the temperature of both the neutral gas and the plasma. Without a diffusive flux, the cold plasma equilibrium profile can be calculated from $\Gamma_B + \Gamma_E = 0$. For the case of an infinitely long plasma and no contribution from the trap's confinement fields, the electric field can be expressed as $E(r) = (4\pi e/r)\int_o^{r'} n(r')dr'$. The condition for equilibrium therefore reduces to $$n(r) = n_0 = \frac{\omega_n B}{2\pi e c}, \tag{5}$$

where $n_0$ is the constant ion density throughout the plasma. Equation (5) is similar to the relation that also describes the T=0 equilibrium profile for a conventional fully ionized non-neutral plasma. The difference between the two cases centers around the fact that the rotational frequency of a WINP is set by the externally imposed neutral gas flow, whereas the rotational frequency of a fully ionized plasma is determined purely by E×B drift. Although a WINP at equilibrium rotates at a speed equal to that expected for an identical plasma in vacuum undergoing E×B drift, this distinction remains crucial. Drifts generally do not occur when $\nu_{in}>>\Omega$, where $\nu_{in}$ is the ion-neutral collision frequency. (An ion in crossed E and B fields moves in two completely different directions depending on whether $\nu_{in}>>\Omega$, or $\nu_{in}<<\Omega$.)

The profile of a WINP with T>0 is best found by comparison with the T>0 equilibrium profile of a fully ionized non-neutral plasma. We show below that the equations governing the detailed equilibrium profile for the two cases are isomorphic. Finite temperature results in the addition of diffusion for a WINP and the addition of pressure forces for a fully ionized plasma. A fully ionized non-neutral plasma must satisfy $F_B+F_EF_P=0$, where $$F_B=-(e\omega_r Br/c)\hat{r} \tag{6}$$

$$F_E=eE \tag{7}$$

$$F_p=-(T\nabla n)/n \tag{8}$$

are the magnetic, electric, and pressure gradient forces, respectively. Equations (6)–(8) are formally equivalent to Eqs. (1)–(3) provided that the Einstein relation $\mu$=eD/T is used to relate mobility and diffusion and provided that the fully ionized plasma rotation frequency $\omega_r$ is identified with the neutral gas rotation frequency $\omega_n$.

The precise mathematical equivalence described above was unexpected. It was further unexpected that the possible equilibrium shapes and profiles of weakly ionized non-neutral plasmas are identical to the equilibrium shapes of fully ionized plasmas. It is therefore possible to apply much of the previous work on plasma shapes and profiles to a WINP. Specifically, the plasma must have an interior of roughly constant charge density and a relatively thin "edge" with a thickness of roughly the Debye length $\lambda_D=\sqrt{T/4\pi ne^2}$. As with fully ionized non-neutral plasmas, wall loss of ions should be negligible because the exterior plasma density decreases approximately exponentially with radius.

Ion transport within a WINP is constrained by none of the usual angular momentum or energy conservation principles affecting fully ionized non-neutral plasmas that are found in standard references. The WINP can gain or lose both energy and angular momentum via interaction with the rotating neutral gas. At atmospheric pressure, the angular momentum associated with the rotational motion of the neutral gas greatly exceeds the canonical angular momentum of the WINP's equilibrium state. In any case, the torque necessary to cause transport within the WINP must be externally supplied as the force necessary to maintain the neutral gas motion. Initially, the WINP's density and radius may be far from their required equilibrium values. Rapid initial transport causes the WINP to shrink or expand radially, reaching a state of approximate equilibrium.

The approximate timescale for this initial transport can be found by setting T=D=0 and assuming an infinitely long WINP plasma of constant density $n_0+\delta n$, where $n_0$ is the cold-plasma equilibrium density given by Eq. (5). Charge conservation requires that $$\frac{\partial(n_0+\delta n)}{\partial t}=\nabla\cdot(\Gamma_B+\Gamma_E) \tag{9}$$

Elimination of $n_0$ yields a differential equation that can be solved for the approximate time dependence of a small density perturbation $\delta n(t)\approx\delta n(0)e^{-}t/rf$, where the "fast" transport time constant is given by $$\tau_f=c/\mu\omega_n B \tag{10}$$

As the neutral gas pressure is lowered to a pressure of about 100 mTorr or less, one expects to recover the behavior of a conventional, fully ionized non-neutral plasma. The transition occurs at neutral gas pressures such that $\nu_{in}\approx\Omega$. Above this pressure, the plasma is effectively forced to follow the neutral gas flow and transport occurs as described in this section. Below this pressure, the plasma's rotational velocity is effectively set by the action of E×B drift. Although interaction with the neutral gas may still lead to significant transport, the relations described herein will cease to be valid.

Before a WINP can completely reach equilibrium, slower diffusive transport must occur primarily to establish the plasma's detailed edge profile. Since the expected size of the region over which diffusion should be important is roughly $\lambda_D$, the slow diffusive timescale can be written $$\tau_s=\lambda_D^2/D \tag{11}$$

Figure 3:
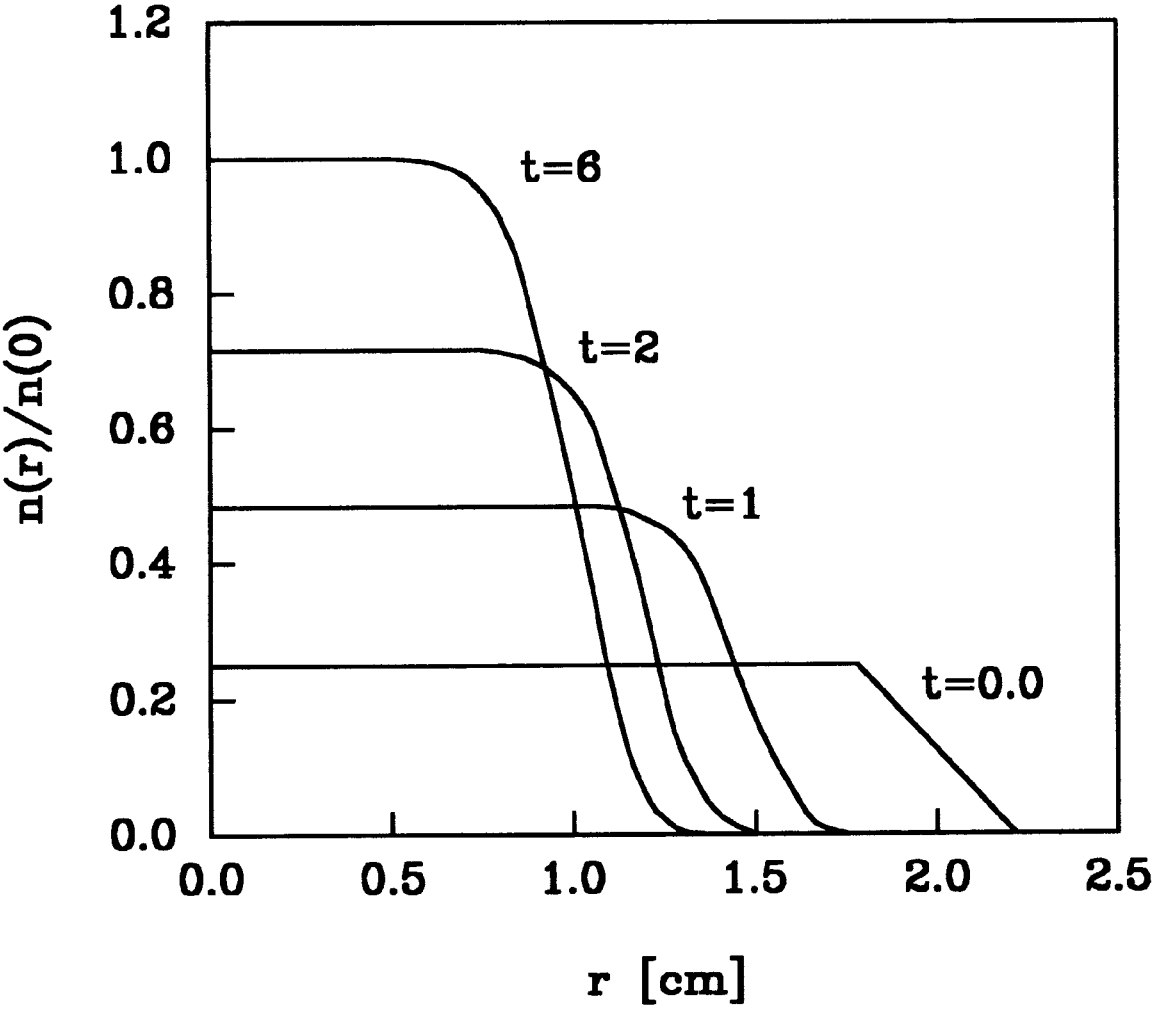
FIG. 3 is a graph describing conservation of charge for a weakly ionized non-neutral plasma.

Note that the ratio of the slow diffusion timescale to the fast electrostatic timescale is $\tau_s/\tau_f=½$. FIG. 3 shows evolution of the radial profile of a plasma with initial density and temperature such that $r_p/\lambda_D=10$ at equilibrium, where$_p$ r is the plasma radius. The data displayed in FIG. 3 were generated by a straightforward numerical solution to the relation $\partial n(r)/\partial t=\nabla\cdot(\Gamma_D+\Gamma_E+\Gamma_B)$, which describes conservation of charge for this dynamical system. As expected, equilibration is nearly complete after a time of $6\tau_f$.

Confinement of a WINP in a trap with idealized neutral gas flow is extraordinarily stable. Other than the exponentially small loss of ions at the outer wall and axial ends, there is no transport process by which the plasma can be lost. Any deviation of the plasma's profile from the equilibrium profile will be undone on roughly the timescale $\tau_f$. The conditions necessary for successful trapping of a weakly ionized non-neutral plasma are obtainable in practice. A sharp point (or array of points) undergoing stable corona discharge supplies at least $10^{-3}$ Amperes of either positive or negative ion current. Such a plasma source would function at atmospheric pressure in a wide variety of chemical environments. A rapidly rotating, turbulence-free neutral gas could be provided by a technology similar to that used for sample spinning in NMR chemical analysis, or any of a variety of centrifugal separation technologies. Rotation rates of 1–10 kHz are achievable for a small laboratory trap.

Numerical evaluation of typical plasma characteristics requires an estimate of the ion mobility and diffusion constants within the trap. As an example, we assume a plasma consisting of singly charged, lightweight ions in air at a temperature of 0.025 eV. The ion-neutral collision frequency for a variety of non-polar neutral species is roughly $\nu_{in}\approx(10^{-9}\text{cm}^3/\text{s})n_n$, where $n_n$ is the neutral species density. Estimation of $\mu$ and D at atmospheric pressure yields $\mu=e/m\nu_{in}$=380 esu-s/g and $D=T/m\nu_{in}$=0.032 $\text{cm}^2/\text{s}$, where we have assumed for simplicity that the ion mass is roughly equal to the mass of the nitrogen molecule. Further assuming a trap with $\omega_n=3000\text{s}^{-1}$ and $B=10^4$G, Eqs. (5) and (10) predict a plasma with a density $n=3.3\times10^5\text{cm}^{-3}$ and equilibration time constant $\tau_f$=1.3s. The trapped plasma should exhibit collective behavior because the plasma's radius and Debye length can easily be made to satisfy $r_p/\lambda_D>>1$. It is also evident that the plasma is not highly correlated because the "plasma parameter" $\Lambda=n\lambda_D^3$ is much greater than one. The fact that $\nu_{in}>>\Omega$ ensures that ion-neutral collisions are of dominant importance in the plasma dynamics. The pressure at which the transition to conventional fully ionized non-neutral plasma behavior is expected is roughly 100 mTorr.

The consequences of violating four of the primary assumptions used in the calculation of a WINP's equilibrium and nonequilibrium properties are examined.

Asymmetry

The effects of mechanical, electrical, or magnetic asymmetry on the confinement of a WINP are far more straightforward and limited than on the confinement of a conventional fully ionized non-neutral plasma. For a fixed total amount of charge in a specific trap there is a unique equilibrium state. Asymmetries may modify this equilibrium state, but surprisingly cannot cause a gradual evolution as occurs for fully ionized plasmas.

The general response of a WINP to asymmetries can be illustrated by considering the application of a magnetic "tilt" $B_X\hat{x}$ to an otherwise symmetric trap with an axial magnetic field $B\hat{z}$. Under such conditions, a fully ionized plasma remains aligned with the total magnetic field $B_X\hat{x}+B\hat{z}$ and experiences enhanced radial transport. In contrast, a WINP remains centered about the axis of neutral gas rotational flow, which normally coincides with the trap axis. Ions are subjected to an oscillatory force $(q\omega_n rB_X/c)\hat{z}\sin(\omega_n t)$, which causes them to undergo an axial oscillation over a distance of $2\pi B_X r/c$. Even for tilt angles as large as $\pi/4$, this oscillation distance is small compared to the trap dimensions! Therefore, poor uniformity and alignment of the trap magnetic field have no appreciable effect on WINP confinement other than a slight modification of the equilibrium state.

Sheared flow

An important non-ideality that may be present in laboratory experiments is neutral gas flow with a rotational frequency that depends on radius. Note that under these conditions the plasma reaches a state with significant shear. We here generalize Eq. (5) to account for this possibility in a plasma that can be approximated as cold ($T\approx 0$, $D\approx 0$.) Letting $\omega_n=\omega_n(r)$ and requiring that $\Gamma_E=-\Gamma_B$ yields the relation $$\frac{\omega_n(r)Br^2}{4\pi ec} = \int_0^r r'n(r')dr', \tag{12}$$

where the substitution $E(r)=(4\pi e/r)\int_0^r r'n(r')dr'$ has been made for the electric field. Equation (12) can be solved for the generalized cold plasma density profile $$n(r) = \frac{(2\omega_n(r) + rd\omega_n(r)/dr)B}{4\pi ec} \tag{13}$$

Equation (13) predicts that whenever the rotational frequency decreases faster than $1/r^2$, plasma composed of oppositely charged species are present. Equation (13) would thus be unphysical unless ions of both sign of charge are available in sufficient quantity. Ion recombination could prevent the formation of a steady-state plasma with rotation profiles of this type. It should be noted that we do not use the term "equilibrium" to describe the steady-state condition of a permanently sheared plasma because continuing interaction between the neutral gas and the external world is necessary to maintain shear in any real system. It was unexpected that a confinement remains stable notwithstanding the presence of a shear condition.

Irregular gas flow

As discussed above, mechanical asymmetry should have a negligible effect on the plasma unless it disrupts the neutral gas flow. Any disruption of the neutral gas flow that leads to an irregular or turbulent flow can significantly alter the equilibrium profile or lead to loss of confinement. One approximate treatment of such flow assumes an enhanced diffusion and therefore an elevated value for D. Thus, an irregular flow increases the effective Debye length $\lambda_D$ of the plasma's equilibrium profile. Should severe turbulence occur, the plasma comes into contact with the outer wall and will eventually decrease in size or be lost entirely.

Oppositely signed charge

The sign of charge that can be confined in a trap is given by $-\hat{\omega}\cdot B/|B|$. As in a fully ionized non-neutral plasma, oppositely charged ions are attracted by the confinement potentials at the axial ends of the plasma. Since the axial electric fields within the plasma are necessarily zero, axial loss is a diffusion limited process and is therefore very slow in a long plasma. Radial transport also provides a significant loss mechanism for oppositely charged ions. The total radial flux for an oppositely charged "test ion" in an equilibrium plasma is $$\sum\Gamma = \Gamma_D + \Gamma_B + \Gamma_E \tag{14}$$

$$= \Gamma_D - \Gamma_B^0 - \Gamma_E^0 \tag{15}$$

$$= \Gamma_D + \Gamma_{D'}^0 \tag{16}$$

where $\Gamma_D{}^0$, $\Gamma_B{}^0$, and $\Gamma_D{}^0$ are the fluxes for the trapped species. Clearly, the test ion must eventually be expelled by the action of the purely diffusive terms in Eq. (14).

Closure

A preferred embodiment of the present invention has been shown and described. In addition, The present invention of trapping weakly ionized gas has been described in terms of its similarities to and differences from conventional or fully ionized non-neutral plasma. Its three-dimensional equilibrium density profile is normally very similar to that of the corresponding fully-ionized plasma. Although inertial effects are quite different in a WINP, laboratory plasmas are likely to correspond to fully ionized plasmas that are well below the Brillouin limit. A WINP can exist stably in a sheared state, although under these conditions energy must be externally input via the neutral gas. The transport mechanisms that drive a WINP toward equilibrium are, of course, drastically different from those in a fully ionized plasma. The plasma undergoes rapid transport leading to a state in which its density profile is appropriate for the imposed rotational frequency. Notably, it should be possible to confine a WINP indefinitely even in a trap with poor magnetic alignment or uniformity. Mechanical precision is necessary only to the extent that mechanical asymmetries can disrupt the rotational flow of the neutral gas.

Accordingly, it will be apparent to those skilled in the art that many changes and modifications may be made without departing from the invention in its broader aspects. The appended claims are therefore intended to cover all such changes and modifications as fall within the true spirit and scope of the invention.

We claim:

1. A method of trapping ions, comprising the steps of:

(a) passing a mixture of said ions with a neutral gas through a corona discharge thereby forming a non-neutral plasma of the ions;

(b) flowing the non-neutral plasma through a magnetic field wherein the flow is substantially transverse to the magnetic field lines and has a rotational flow component; thereby (c) trapping the ions at a temperature of the neutral gas within the magnetic field.

2. The method as recited in claim 1, wherein the flow is within a containment vessel with a magnet external to the containment vessel.

3. The method as recited in claim 2, wherein the rotational flow is induced by rotation of the containment vessel.

4. The method as recited in claim 3, further comprising an axial flow component.

5. The method as recited in claim 1, wherein the rotational flow component is selected from the group consisting of circular, vortex, toroidal, and combinations thereof.

6. The method as recited in claim 5, further comprising an axial flow component.

7. The method as recited in claim 1, wherein said mixture is at a pressure above 100 mTorr.

8. An apparatus for trapping ions, comprising:

(a) a magnet with a magnetic field;

(b) a source of a gas mixture having a neutral gas and ions;

(c) a confinement imparting a rotational flow component to the gas mixture through the magnetic field and substantially transverse to the magnetic field lines; and (d) at least one corona discharge electrode within the confinement for forming a non-neutral plasma of the ions at a temperature of the neutral gas.

9. The apparatus as recited in claim 8, wherein said ions are a weakly ionized non-neutral plasma.

10. The apparatus as recited in claim 8, wherein said confinement is a containment vessel having the gas mixture within, and said magnet external from the containment vessel.

11. The apparatus as recited in claim 10, wherein the rotational flow is induced by rotation of the containment vessel.

12. The apparatus as recited in claim 8, wherein the confinement is selected from the group consisting of a containment vessel, a curved surface, a pressure boundary, and combinations thereof.

13. The apparatus as recited in claim 8, wherein said gas mixture is at a pressure above 100 mTorr.

14. A method of trapping ions, comprising the steps of:

(a) passing a mixture of said ions with a neutral gas through a corona discharge thereby forming a non-neutral plasma of the ions; and (b) flowing the non-neutral plasma mixture through a magnetic field wherein the flow is substantially transverse to the magnetic field lines and has a rotational flow component.

15. An apparatus for trapping ions, comprising:

(a) a magnet with a magnetic field;

(b) a non-neutral corona discharge plasma of a gas mixture having a neutral gas and ions; and (c) a confinement imparting a rotational flow component to the non-neutral corona discharge plasma through the magnetic field and substantially transverse to the magnetic field lines.

* * * * *

UNITED STATES PATENT AND TRADEMARK OFFICE

CERTIFICATE OF CORRECTION

PATENT NO. : 5,931,986
DATED : August 3, 1999
INVENTOR(S) : Peurrung et al.

It is certified that error appears in the above-identified patent and that said Letters Patent is hereby corrected as shown below:

Column 3,
Line 17, please replace "($107_n$)" with -- ($\omega_n$) --.

Column9,
Line 11, please replace "claim 5," with -- claim 3, --.

Signed and Sealed this

Eighth Day of January, 2002

*Attest:*

*Attesting Officer*

JAMES E. ROGAN
*Director of the United States Patent and Trademark Office*